US005664908A

United States Patent [19]

Paladeni

[11] Patent Number: 5,664,908

[45] Date of Patent: Sep. 9, 1997

[54] POWERED ROTARY SCREED

[76] Inventor: Tod Paladeni, 1316 NW. Westridge St., Vancouver, Wash. 98665

[21] Appl. No.: 536,191

[22] Filed: Sep. 29, 1995

Related U.S. Application Data

[63] Continuation-in-part of Ser. No. 262,591, Jun. 20, 1994, Pat. No. 5,456,549.

[51] Int. Cl.[6] ..... E01C 19/22

[52] U.S. Cl. ..... 404/103; 404/119; 404/123

[58] Field of Search ..... 404/85, 96, 103, 404/104, 112, 118, 125, 126, 132, 123, 119, 120

[56] References Cited

U.S. PATENT DOCUMENTS

| | | | |
|---|---|---|---|
| 4,577,994 | 3/1986 | Miller . | |
| 4,614,486 | 9/1986 | Bragagnini | 404/103 X |
| 4,747,726 | 5/1988 | Garner et al. | 404/123 |
| 4,913,584 | 4/1990 | Garner et al. | 404/123 |
| 4,931,008 | 6/1990 | Morrison . | |
| 4,964,754 | 10/1990 | Garner et al. . | |
| 5,046,889 | 9/1991 | Sterner, Jr. | 404/103 |
| 5,190,400 | 3/1993 | Sterner | 404/103 |
| 5,456,549 | 10/1995 | Paladeni | 404/103 |
| 5,507,591 | 4/1996 | Lyons et al. | 404/96 |

OTHER PUBLICATIONS

"Razorback Scrreds", Allen Engineering Corporation Advertising Brochure, Paragould, Arkansas, 1992.

*Primary Examiner*—James Lisehora

*Attorney, Agent, or Firm*—Klarquist Sparkman Campbell Leigh & Whinston, LLP

[57] ABSTRACT

A powered rotary screed has a plurality of interchangeable modules of different lengths so that the power screed can accommodate various sizes of screed jobs. Additionally, the rotary screed comprises a centrally located expansion member that can be adjusted to cause an upper ridge member of the rotary screed to expand outward, thus raising a medial portion of the roller screeds so that they may be adjusted to maintain horizontal alignment. The screed is propelled by drive tubes that are supported by drive modules and powered by hydraulic motors. The screed further comprises a two-section strike tube which is likewise powered by a hydraulic motor. An operator rides in an operator's station and controls the speed and direction of the rotary screed. The drive tubes include a leading drive tube which is vertically adjustable to adjust the amount of pressure of the strike tube upon the concrete form.

19 Claims, 4 Drawing Sheets

POWERED ROTARY SCREED

CROSS-REFERENCE TO RELATED APPLICATION

This application is a continuation in part of U.S. patent application Ser. No. 08/262,591 filed on Jun. 20, 1994, now U.S. Pat. No. 5,456,549.

BACKGROUND OF THE INVENTION

1. Field of the Invention

This invention pertains to the field of screeds for screeding cementitious material and more particularly to power-driven roller screeds.

2. Description of the Related Art

A non-powered roller screed is sold by Bunyan Industries of Salt Lake City, Utah. The roller screed consists of an elongate tube having rotatably mounted handles at its distal ends. The roller screed is used on freshly poured cement by placing it on top of a pair of spaced apart, parallel rails that are set level with the desired surface height for the concrete pad being formed. The roller screed is then pulled along the top of the rails pushing excess cement ahead of it and leaving a flat, level surface behind it which may be finished with trowels after the cement has cured enough to support the weight of people and tools. Several deficiencies can be readily noted with the roller screed just described: mainly, being manually operated, it requires two strong operators to pull the screed and move excess cement, and the length of the screed is limited. Screeds over twenty feet long sag in the center and create an uneven cement surface. Thus, it is desirable to create a roller screed that is easier to operate and that can be longer than twenty feet without sagging.

A powered screed is shown in Morrison, U.S. Pat. No. 4,931,008, which discloses a vibrating screed that structurally consists of a ridge beam supported by a plurality of knee braces connected to a T-shaped screed blade and a bull float blade. The individual sections are connected by a modified turnbuckle that can be adjusted to make the screed and bull float blades level. This general concept has been incorporated into screeds sold by M-B-W, Inc., of Slinger, Wis., which claims that its screeds can maintain commercial finishing tolerances at screed lengths up to 60 feet. However, the angle iron screed blades associated with these screeds are less desirable than roller screeds.

A powered roller screed is shown in Garner et al., U.S. Pat. No. 4,964,754, which discloses an operator driven power roller screed having tandem drive rollers and a screed roller. Although Garner et al. overcomes the problems associated with the manual roller screed, the apparatus is large and cumbersome to move into place and must be relatively short, as compared to the Morrison-style screed, to avoid sagging in the middle.

SUMMARY OF THE INVENTION

The present invention solves the above-noted deficiencies by providing a modular, powered, rotary screed system having a centrally located adjustment member for vertically adjusting the screed so that it can be kept flat, even with long lengths. Preferably, the powered rotary screed of the present invention comprises two drive modules and two screed modules. The modules are arranged so the screed modules are connected together and the drive modules are at the outermost, distal ends of the rotary screed system.

Each drive module has a frame structure with vertically arranged plates at its ends. At least one drive tube is rotatably connected to the plates and powered by an hydraulic motor. One drive module may support a power supply and hydraulic pump, while the other drive module may support an operator station having controls and a seat for an operator. The hydraulically driven drive tubes are the motive force for propelling the rotary screed.

Preferably, the screed modules are available in four-foot lengths so the overall screed length can be configured for specific job sizes. Each screed module has a frame that is connected at one end to one of the plates associated with the drive module and is connected at its other end to a medial plate. A strike tube is associated with each such screed module and is supported by the medial plate at one end and supported at its other end by an outermost, or distal, plate associated with each drive module.

In the preferred embodiment, the module frames spanning the vertically arranged plates comprise three horizontally oriented stringers (one ridge stringer and two base stringers). Further structural rigidity may be provided by braces between the stringers. The stringers connect to the plates by bolted connections except at the point where the ridge stringers connect to the medial plate, which connects by means of an adjustment member.

Preferably, the adjustment member is a pair of power screws that are threaded into the ridge stringers and are rotatably connected to the medial plate. The power screws adjust the horizontal alignment of the strike tubes so that the strike tubes will not sag when the screed is configured into long lengths. The adjustment works by rotating the power screws so they thread out of the ridge stringers and press against the medial plate, thereby increasing the effective length of the ridge stringers. The system accommodates the increased ridge stringer length by "bowing" so that the medial portion of the rotary screed raises vertically.

The foregoing and additional features and advantages of the present invention will be more readily apparent from the following detailed description, which proceeds with reference to the accompanying drawings.

DETAILED DESCRIPTION OF THE PREFERRED EMBODIMENT

Figure 1:
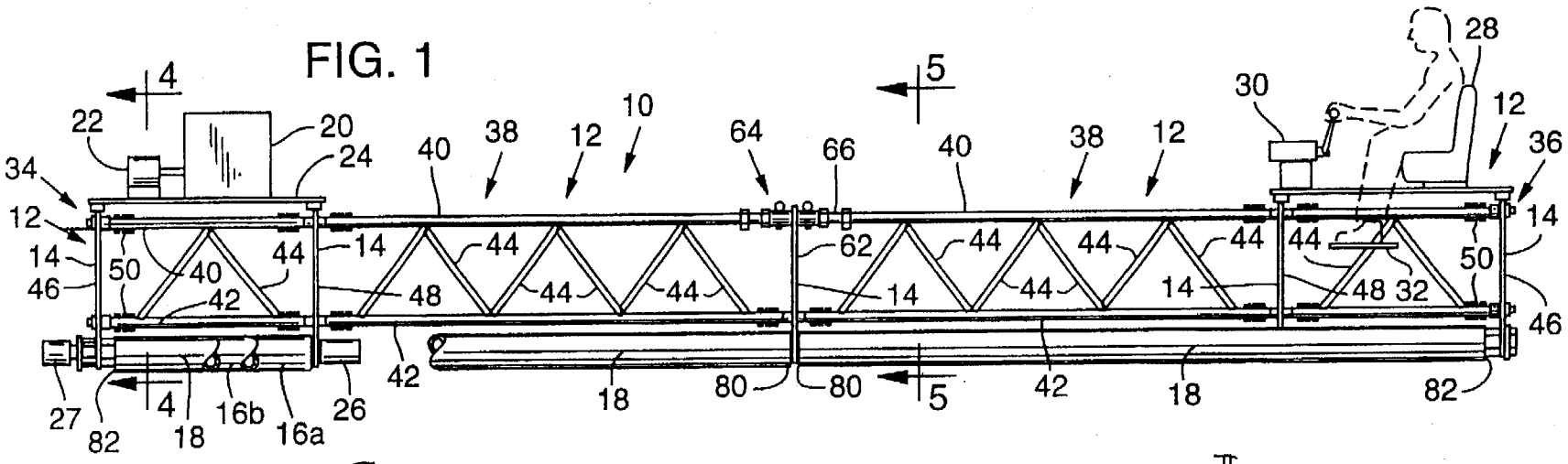
FIG. 1 is a front, elevation view of a preferred embodiment of a powered rotary screed of the present invention.

In FIG. 1 there is shown a front elevation view of a powered rotary screed 10 of the present invention. In this preferred embodiment, the rotary screed is comprised of four modules 12 separated by structural plates 14. Drive tubes 16*a* and 16*b* (only left side drive tubes are shown) and a strike tube 18 are rotatably connected to the plates 14. At one end of the rotary screed a power supply 20 and hydraulic pump 22 are mounted onto a platform 24. The hydraulic pump supplies hydraulic pressure to hydraulic motors 26 which power the drive tubes 16*a* and 16*b* and motors 27 which rotate the strike tubes 18. At the other end of the rotary screed there is located an operator station having a seat 28, control station 30 and foot rest 32.

As stated, the rotary screed 10 is preferably comprised of four modules 12. In the preferred embodiment, the modules comprise drive modules 34 and 36 and screed modules 38. All the modules 12 share the common characteristic of a frame section having a ridge stringer 40 whose ends are connected to the top portions of the structural plates 14 and two base stringers 42 connected to the bottom portions of the plates 14. The ridge stringers and base stringers are interconnected by braces 44 for rigidity.

The drive modules 34 and 36 are preferably a standard length of approximately four feet. The drive modules 34, 36 have a frame including the stringers 40 and 42. At their outermost, distal ends, the stringers 40, 42 are connected to a distal plate 46 by a fastening system 50. At their other end, the stringers 40, 42 are connected to an intermediate plate 48 again by fastening system 50.

Figure 2:
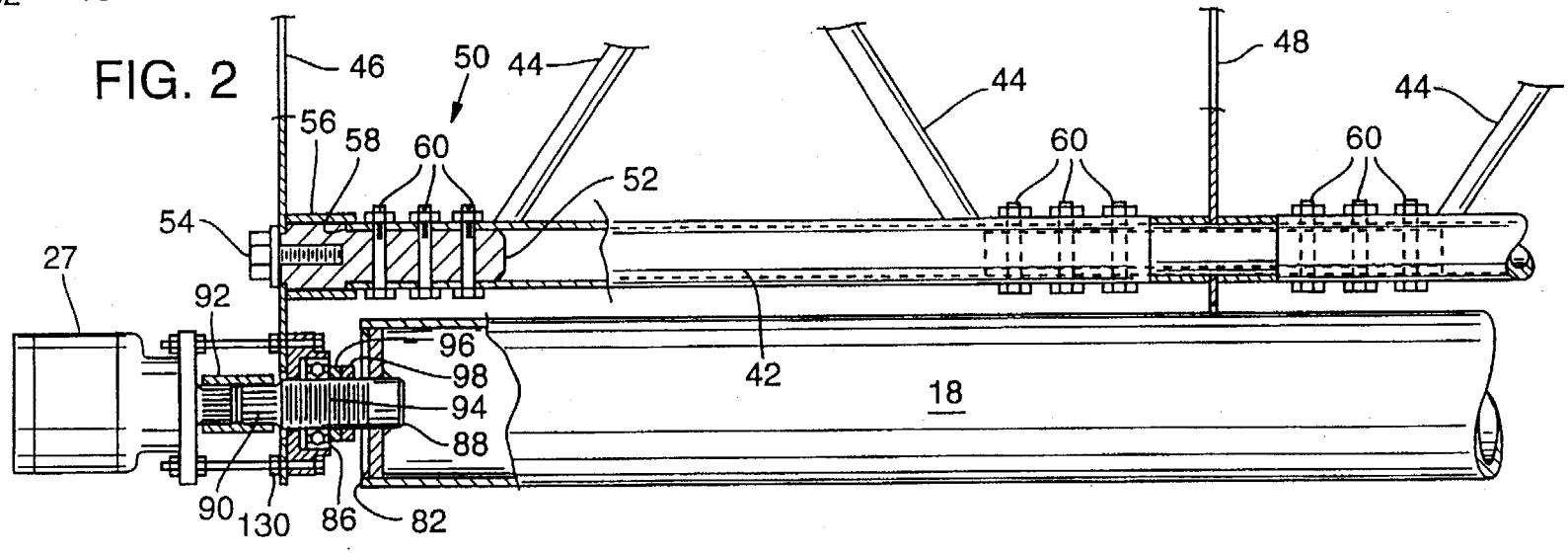
FIG. 2 is an enlarged front, elevation view of the powered rotary screed of FIG. 1 that has been partially cut away to show details of the connections of various frame components and the connection of a roller screed (strike tube) to a plate and hydraulic motor.

As can be seen in greater detail in FIG. 2, the fastening system 50 comprises a tenon 52 that is bolted to the distal plate 46 by a bolt 54. The tenon is received within a socket 56 that is welded to the distal plate 46. The base stringer 42 fits over an end of the tenon 52 and slides toward the distal plate 46 until it abuts shoulders 58 on the tenon 52. Holes are provided through the base stringer 42 and tenon 52 to receive bolts 60 for securing the stringer and, in turn, the distal plate 46. In a like manner, all of the stringers are connected to the structural plates 14 with the exception of the medial connections of the ridge stringer 40, which connection will be described separately below.

Preferably, both drive modules 34, 36 include two drive tubes 16*a* and 16*b* that span between the distal plate 46 and the intermediate plate 48. An hydraulic motor 26 is coupled to the drive tubes 16*a* for rotating the drive tubes which in turn propels the rotary screed 10. Drive tubes 16*b* are coupled to the drive tubes 16*a* by a drive chain 114. The drive tubes are rotatably coupled to plates 46, 48 by means of commercially available rotary thrust bearings 86. The drive tubes will preferably have a high friction surface such as textured steel, rubber or other elastomeric material.

The screed modules 38 are preferably available in a plurality of lengths at four-foot increments. For example, screed modules may be available at lengths of 4, 8,.12, 16 feet, etc. The four-foot increments of the screed modules coincide with the preferred embodiment of the four-foot length for the drive modules so that the rotary screed can always be configured for the proper width of a screed job. As noted above, screeds ride on guide rails (not shown). By coordinating the length increments of the screed modules to the preferred length of the drive modules, the rotary screed 10 can always be configured so that the drive rollers will ride on guide rails regardless of their separation distance.

Each screed module 38 connects at one end to one intermediate plate 48 and connects at its other end to a medial plate 62. As stated above, the screed modules 38 have the ridge stringer 40 and two base stringers 42 that are interconnected by the braces 44.

The ridge stringers of the screed modules 38 connect at the medial plate 62 by means of an expansion member 64. As seen most clearly in FIG. 3, the expansion member 64 comprises two power screws 66 that thread into collars 68 that are welded to the ridge stringers 40. Each power screw 66 is provided with a threaded portion 70, a shoulder nut 72 and a smooth surface stub 74. The stub 74 is received within a receptacle 76 that is welded to the medial plate 62. A hole is provided through receptacle 76 and stub 74 to receive a pin 78 for securing the power screw 66. Because the stub is smooth-surfaced, it is easily removed from, and inserted into, the receptacles 76, without turning the power screws 66 or unscrewing them from the ridge stringer 40.

The purpose of the expansion member 64 is to adjust the effective length of the ridge stringers 40. When one or both of the screws 66 are rotated to increase the effective length of the ridge stringers 40, top portions of the plates 46, 48 on one side of the medial plate are moved away from top portions of the corresponding plates 46, 48 on the other side of the medial plate, thereby causing the medial plate 62 to move upward raising medial ends 80 of the strike tubes. In this manner, the rotary screed 10 can be configured for long lengths because any sag that occurs in which the medial ends 80 of the strike tubes dip below distal ends 82 can be adjusted by turning the power screws 66.

A platform 24 is mounted onto the top of the drive module 34 for supporting a power supply 20 and pump 22. Preferably, the power supply 20 is a gasoline-powered engine that is coupled to a hydraulic pump 22 for generating hydraulic pressure for running hydraulic motors 26 and 27. Alternatively, the power supply 20 could be a gasoline-powered generator generating electricity to drive an electric hydraulic pump that would supply hydraulic pressure to run the hydraulic motors. Alternatively, the power supply could be an electric generator supplying electricity to electric motors, instead of the hydraulic system with hydraulic motors 26, 27.

On top of the drive module 36 is an operator station having seat 28 and control panel 30. Preferably, the operator will have controls for controlling the speed and direction of each drive tube 16 individually as well as for controlling the direction and rotary speed of the strike tubes 18.

As noted, the rotary screed 10 preferably comprises two left side drive tubes 16*a* and 16*b*, two right side drive tubes 16*a* and 16*b*, and two strike tubes 18. Each drive tube extends between one distal plate 46 and one intermediate plate 48. Each strike tube 18 extends from one distal plate 46 to the medial plate 62, passing beneath, or in front of, the intermediate plates 48. Hydraulic motors 26 drive the drive tubes 16*a*. Drive tubes 16*b* are driven by chain 114 coupled to drive tubes 16*a*. The chain 114 may be provided with an escutcheon (not shown) for safety. Hydraulic motor 27 drives the strike tubes 18. Preferably, the strike tubes will be driven in a rotational direction opposite to that of the drive tubes for optimal screeding of the cementitious material. In the preferred embodiment, the drive tubes will be capable of propelling the screed 10 at speeds up to 45 ft/min. and the strike tubes can be rotated at speeds up to 200 rpm.

Figure 3:
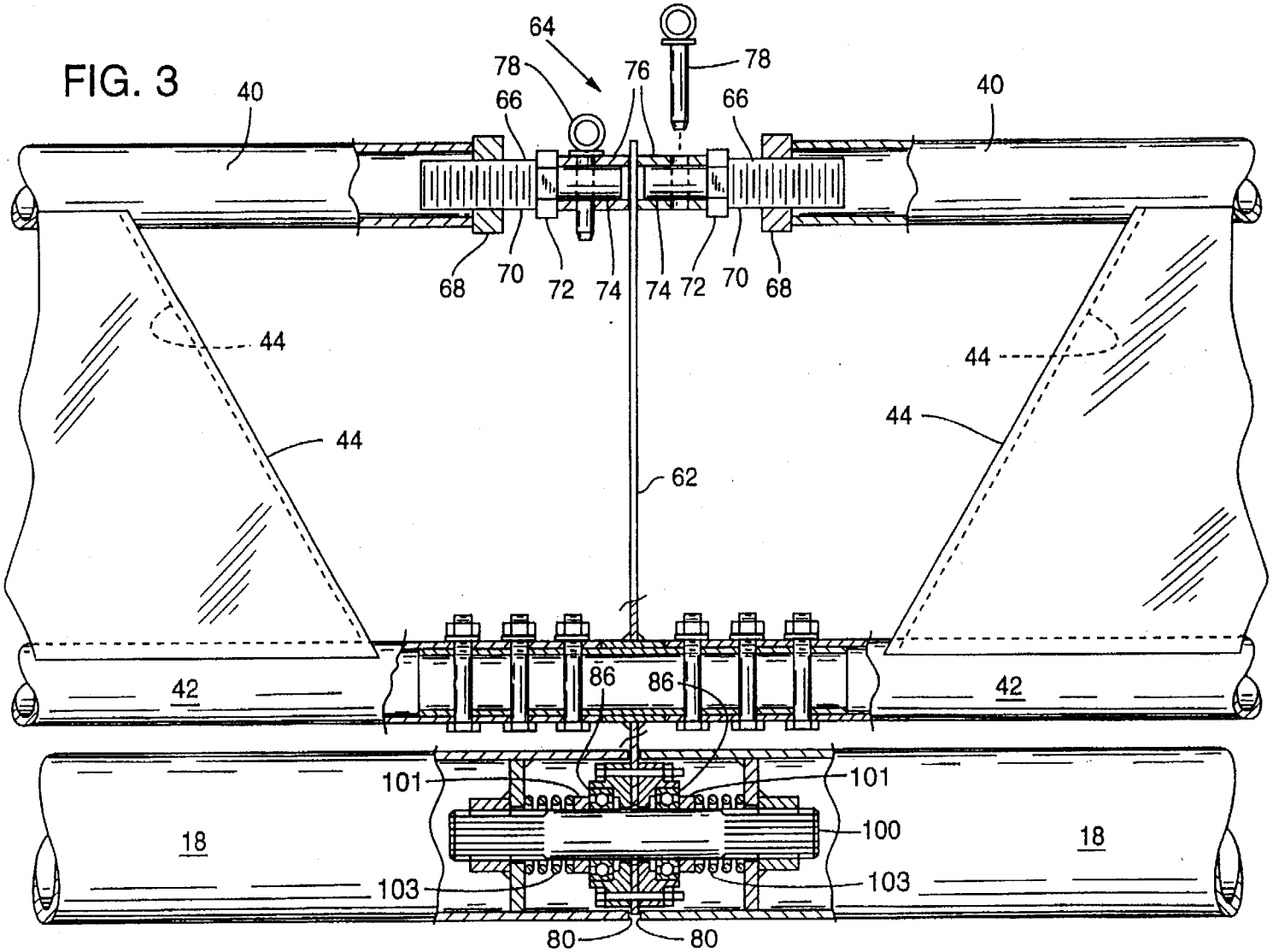
FIG. 3 is an enlarged front elevation view of the powered rotary screed of FIG. 1 that has been partially cut away to show the detail of the frame connection to a medial plate.

As best shown in FIG. 2, the tube 18 is connected to the plate 14 by a thrust bearing 86 that is bolted to the plate. Where the tubes connect to a hydraulic motor 27, a splined and threaded shaft 88 is provided wherein the splined portion 90 passes through bearing 86 and the plate and connects to a coupler 92, which in turn connects to the hydraulic motor 27. On a threaded portion 94 of the shaft 88 are two nuts: jam nut 96 and lock nut 98. With reference to FIG. 2, it can be seen that turning jam nut 96 so that it progresses along the threaded portion 94 in the direction of the hydraulic motor 27 will urge the strike tube 18 away from the distal plate 46 and toward the medial plate 62. The adjustment of the strike tube 18 in the direction of the medial plate 62 is resisted by a compression spring 103 (FIG. 3). After the jam nut 96 has been properly snugged against the thrust bearing 86 so that the strike tube 18 is properly mounted between the distal plate 46 and the medial plate 62, then the lock nut 98 can be tightened against the jam nut 96 to lock it into position. Drive tubes **16*a* and 16*b* are likewise rotatably connected to plates 48 and hydraulic motors 26**.

The tubes 18 connect to the medial plate 62 in a similar fashion. In FIG. 3 it is seen that the strike tubes 18 are fixedly connected to a splined shaft 100 that is connected to the thrust bearings 86 by set screws in collars 101. Springs 103 encircle the shaft 100 and are compressed between the strike tubes 18 and the medial plate 62 for urging the strike tubes toward the distal plates 46 so the strike tubes will not rub against the medial plate.

Figure 4:
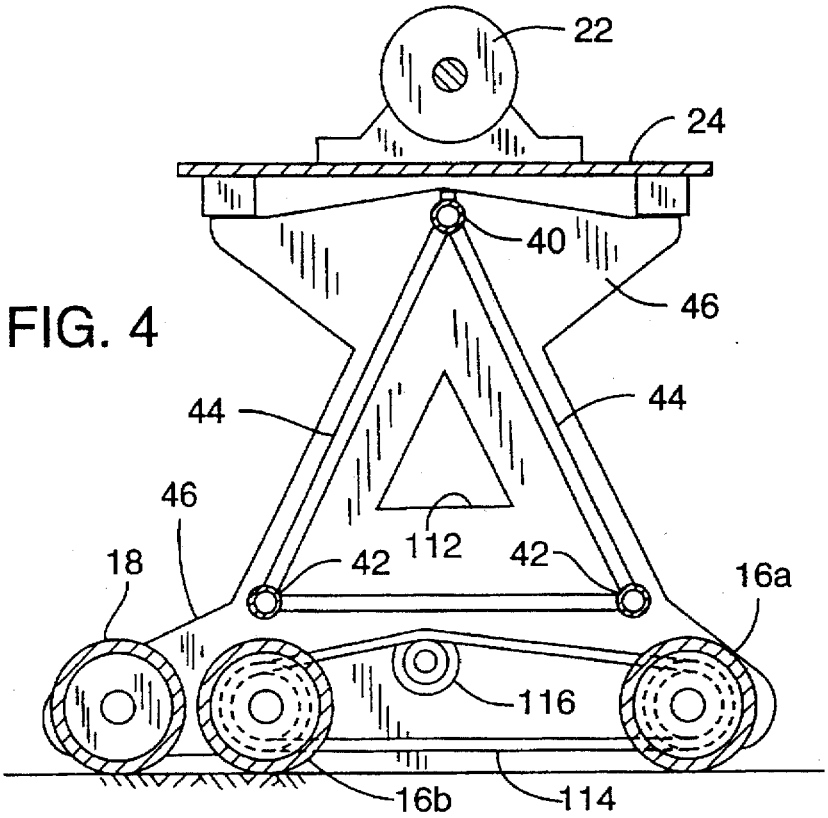
FIG. 4 is a cross-section view taken along line 4—4 in FIG. 1.
Figure 5A:
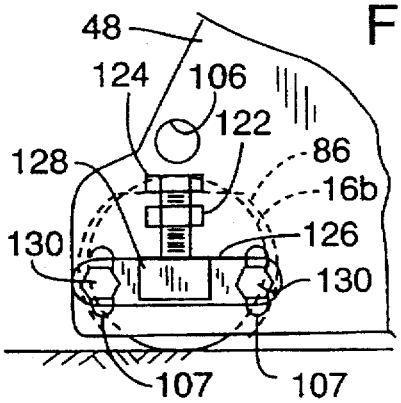
FIG. 5A is an enlarged view of a drive tube adjustment mechanism as viewed from line 5—5 of FIG. 1 without obstruction by plate 62.
Figure 5:
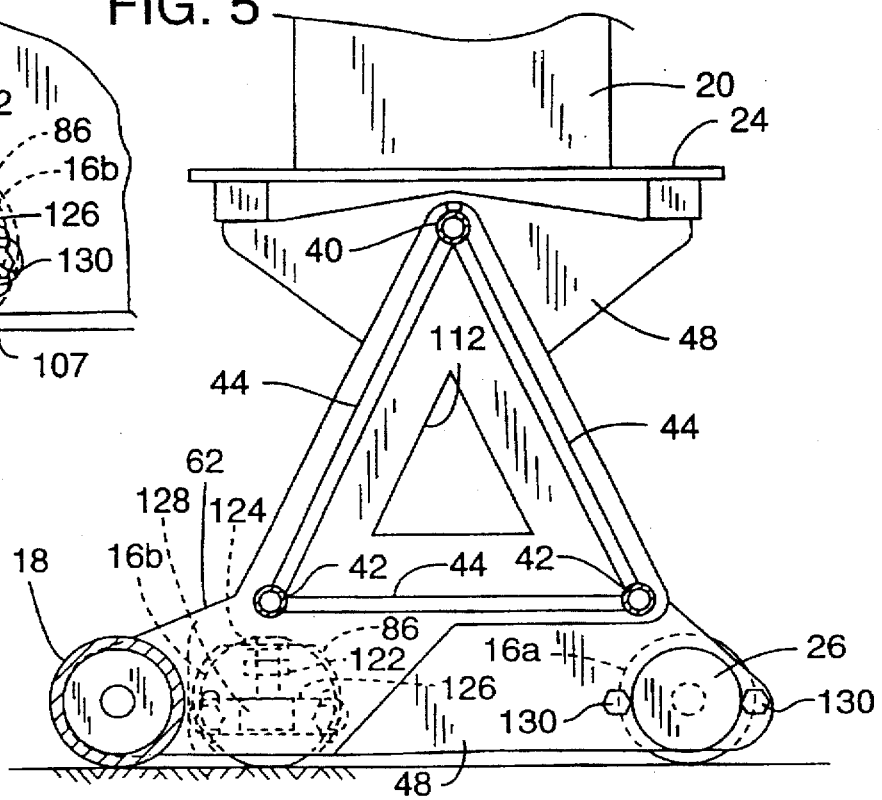
FIG. 5 is a cross-section view taken along line 5—5 of FIG. 1.

FIGS. 4 and 5 show cross-sections taken along lines 4—4 and 5—5 of FIG. 1, respectively. In FIG. 4 there can be seen the hydraulic pump 22 resting atop platform 24 mounted onto a top surface of the distal plate 46. Ridge stringer 40 and base stringers 42 are connected by the braces 44. Drive tubes **16*a* and 16*b* and strike tube 18 are shown connected to lower portions of the distal plates 46. The drive tube 16*b* is coupled to drive tube 16*a* by the drive chain 114 for driving the drive tube 16*b*. An idler gear 116 provides tension adjustment for the chain 114. In FIG. 5 there is shown a further cross-section through the rotary screed 10 looking towards the medial plate 62**.

Figure 6:
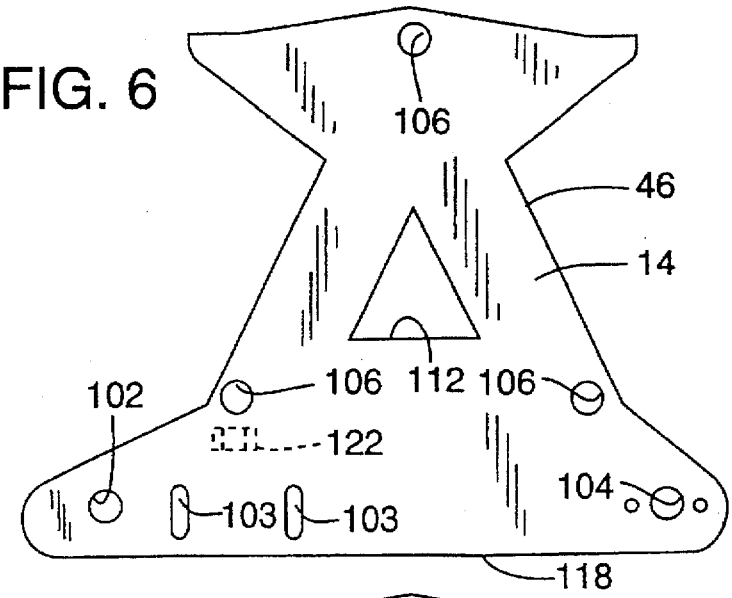
FIG. 6 is a side elevation view of a preferred embodiment of a distal plate of the present invention.
Figure 7:
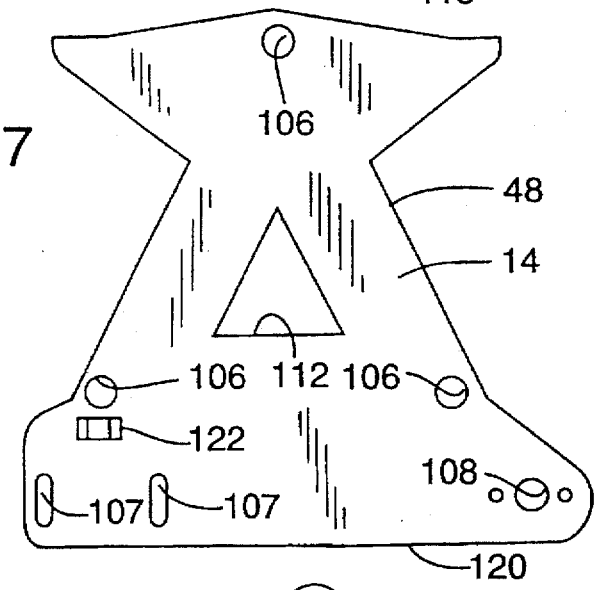
FIG. 7 is a side elevation view of a preferred embodiment of an intermediate plate of the present invention.
Figure 8:
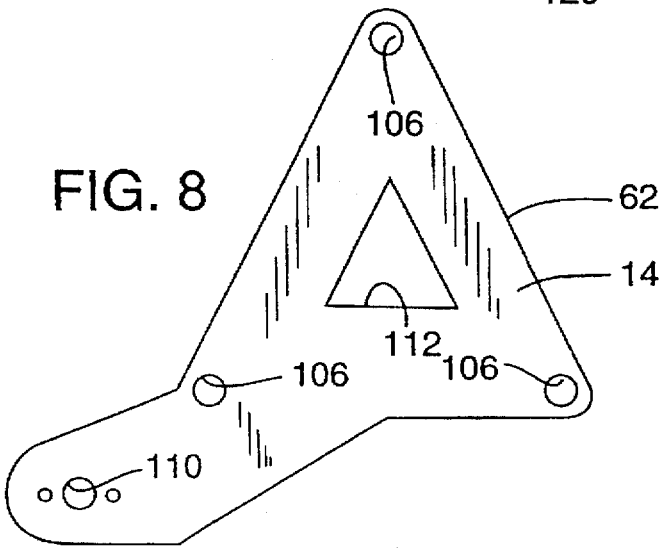
FIG. 8 is a side elevation view of a preferred embodiment of a medial plate of the present invention.

FIGS. 6–8 show the configurations of the distal plate 46, intermediate plate 48 and medial plate 62, respectively. The distal plate 46 contains a hole, 102, along its leading end for receiving the mounting spline of the strike tube. The plate 46 also includes a hole 104 for receiving the spline of the drive tube **106*a*. Slotted holes 103 are for adjustably mounting drive tube 16*b*. A nut 122 is welded to the outside of plate 46 also to accommodate an adjustment mechanism for adjusting drive tube 16*b* as described below. Holes 106 are provided for connection to the stringers 40 and 42**.

The intermediate plate 48 has a hole 108 to receive the connecting spline for the drive tube **16*a* and slotted holes 107 to receive mounting bolts for the drive tube 16*b*. The intermediate plate 48 is cut short at its leading edge 109 to permit the strike tube 18** to pass by the intermediate plate.

Medial plate 62 has a hole 110 for connecting to the strike tubes 18. All of the plates 46, 48, and 62 are provided with a cutout 112 in order to reduce weight.

As can be seen in the drawings and inferred in the above description, drive tube **16*a* is a trailing drive tube and drive tube 16*b* is a leading drive tube. The strike tube 18 is located at the leading edge of the frame structure including the plates 14. The leading drive tube 16*b* is vertically adjustable so that the pressure of a strike tube upon the concrete form may be adjusted for proper operation. Accordingly, with reference to FIGS. 5, 5A, 6 and 7 the adjustment mechanism for the drive tube 16*b*** will be described.

The distal plate 46 and the intermediate plate 48 are provided with slotted holes 103 and 107 to receive bolts associated the rotary thrust bearings 86. As noted, the rotary thrust bearings support the drive tubes and strike tube at their connection to the plates 14. Accordingly, the thrust bearings associated with the drive tube **16*b* are mounted through slotted holes 103 and 107 and may be bolted to the plates anywhere along the slotted holes. Upon inspection, it can be seen that mounting the drive tube 16*b* close to the bottom edges 118 and 120 of the plates 46, 48 will raise the position of the strike tube 18 relative to the surface being screeded. Conversely, if the drive tube 16*b* is mounted at the top of the slotted holes 103, 107 then the strike tube will be exerting considerably more pressure upon the surface being excreted. Preferably, the strike tube 18 will be only slightly above a plane defined by the bottom of the drive tubes 16*a* and 16*b***. Accordingly, fine adjustment is necessary.

To provide the adjustment, nuts 122 are welded onto the plates 46 and 48 thus providing a vertically oriented threaded bore. As can best be seen in FIG. 5A, a bolt 124 is threaded into the nut 122 and presses against a band 126 having a stand-off 128. The stand-off may be provided with a small indentation for receiving the end of the bolt 124. As the bolt 124 is rotated, it processes through the nut 122, but rotates freely with respect to the stand-off 128. Bolts 130 pass through the band 126 and connect to the rotary thrust bearing 86 (not shown) supporting the drive tube **16*b***.

Accordingly, when the nuts 130 are loosened, the thrust bearing, and hence the drive tube **16*b*, are free to move within the slots 103 and 107. Thus, with the screed 10 resting on a surface 132 as shown in FIG. 5, the weight of the screed would tend to move the plates 46 and 48 downward past the drive tube 16*b* and the bolts 130 would ride up in the slots 107 and 103 until the bolt 124 comes into contact with the stand-off 128 on the band 126. The weight of the screed thus rests on the stand-off 128 when the bolts 130 of the thrust bearings 86 are loose. Once the tubes are properly adjusted, the bolts 130 are tightened so that the drive tube 16*b*** is securely attached to the plates.

The preferred method of adjusting the screed is to place the screed on a flat level surface 132 and loosen bolts 130 so that drive tube **16*b* is able to freely float within the slots 103 and 107. With drive tube 16*b* thus loosened, and the bolt 124 backed away from the stand-off 128, the screed will rest upon the strike tube 18 and the trailing drive tube 16*a*. Thereafter, the bolt 124 will be adjusted so that it is moderately snug against the stand-off 128 and all tubes 16*a*, 16*b* and 18 are then resting on the surface 132. The bolt 124 is then turned an additional amount, preferably between one-half turn and three turns so that the weight of the screed is transferred from the strike tube 18 onto the drive tube 16*b*. Preferably, the strike tube would be less than one-eighth of an inch above the surface 132 upon which the drive tubes 16*a* and 16*b* are resting. Finally, the bolts 130 are tightened thereby securing the thrust bearings and the drive tube 16*b* to the respective plates 46 and 48**.

In view of these and the wide variety of other embodiments to which the principals of the invention can be applied, the illustrated embodiments should be considered exemplary only and not as limiting the scope of the invention.

I claim:

1. A powered rotary screed, comprising:

a. at least one elongate drive module, each drive module having at least two plates and a first drive tube rotatably coupled to the at least two plates and a second drive tube rotatably coupled to the at least two plates wherein the drive tubes are rotatably driven to propel the screed; and b. at least one elongate screed module coupled to a drive module plate and longitudinally aligned with a drive module, each screed module having at least one respective rotatable screed tube wherein the respective screed tube substantially extends the length of one screed module and one drive module.

2. A rotary screed for creating a flat surface by screeding uncured materials, comprising:

a. a frame wherein the frame includes two screed modules that are coupled together at a medial plate and a drive module coupled to each distal end of the coupled screed modules, each drive module comprising opposed plates having the first and second drive tubes rotatably coupled thereto;

b. a strike tube rotatably coupled to the medial plate and one drive module and a strike tube coupled to the medial plate and the other drive module and each strike tube located proximate a leading edge of the frame;

c. first drive tubes rotatably coupled to respective drive modules proximate a trailing edge of the frame; and d. second drive tubes rotatably coupled to respective drive modules and located between the first drive tube and the strike tube so that when the rotary screed is screeding the first drive tube and the second drive tube propel the screed and the strike tube screeds uncured material by applying pressure to the material thus pushing excess material forward and providing a flat surface.

3. The rotary screed of claim 2 wherein the second drive tube is adjustable and adjustment of the second drive tube changes the amount of pressure of the strike tube on the uncured material.

4. The rotary screed of claim 2 wherein the drive tubes propel the screed by rotating in a first direction of rotation and the strike tube screeds the uncured material by rotating in a second direction of rotation.

5. The rotary screed of claim 2 wherein at least one stringer is arranged between the plates.

6. The rotary screed of claim 2 wherein the first drive tube and the second drive tube are rotatably driven by a single source of rotational motion.

7. A rotary screed for screeding viscous material, comprising:

a. a frame having a plurality of plates including a medial plate and distal plates and a stringer extending from the medial plate to each distal plate;

b. a strike tube rotatably coupled to at least two plates proximate a leading edge of the frame;

c. a first drive tube rotatably coupled to at least two plates proximate a trailing edge of the frame;

d. a second drive tube rotatably coupled to at least two plates, wherein the second drive tube includes an adjustment that controls an amount of pressure of the strike tube on the concrete form when the screed is screeding the viscous material.

8. The rotary screed of claim 7 wherein the first drive tube and the second drive tube are rotatably driven by a single source of rotational motion.

9. The rotary screed of claim 7 wherein the first drive tube and the second drive tube are rotatably driven by a single source of rotational motion in a first direction of rotation and the strike tube is rotatably driven in a second direction of rotation.

10. The rotary screed of claim 7 wherein the strike tube is rotatably coupled to the medial plate and one distal plate.

11. The rotary screed of claim 7 wherein the strike tube is rotatably coupled to the medial plate and one distal plate to which the first drive tube and the second drive tube are rotatably coupled.

12. The rotary screed of claim 7 further comprising a first strike tube having a first end rotatably coupled to the medial plate and a second end rotatably coupled to one distal plate located at a first distal end of the screed, a second strike tube having a first end rotatably coupled to the medial plate and a second end rotatably coupled to one distal plate at a second distal end of the screed, and further comprising a left pair of first and second drive tubes and a right pair of first and second drive tubes wherein the left pair of drive tubes are rotatably coupled to the first end distal plate and the right pair of drive tubes are rotatably coupled to the second end distal plate.

13. A powered rotary screed, comprising:

a. at least two drive modules, each drive module having at least two plates and a first drive tube rotatably coupled to the plates and second drive tube rotatably coupled to the plates wherein the drive tubes are rotatably driven to propel the screed;

b. a medial plate; and c. at least two screed modules, each screed module having a rotatable screed tube wherein the screed modules are coupled to the medial plate and the drive modules are coupled to the screed modules at distal ends thereof, each screed module including a screed tube that is rotatabaly coupled to the medial plate and a distal plate associated with a drive module such that each screed tube substantially extends the length of a respective screed module and drive module.

14. The powered rotary screed of claim 13 wherein the screed comprises two drive modules and two screed modules and further comprising a medial plate, the screed modules being coupled to the medial plate and the drive modules being coupled to the screed modules at distal ends thereof, each screed tube being rotatably coupled to the medial plate and a distal plate associated with a drive module.

15. The powered rotary screed of claim 13 wherein the screed comprises two drive modules and two screed modules and further comprising a medial plate, the screed modules being coupled to the medial plate and the drive modules being coupled to the screed modules at distal ends thereof, and further comprising an expansion member located between the screed modules proximate the medial plate for expanding the distance between tops of the screed modules so as to level the screed tubes relative to a ground surface.

16. The powered rotary screed of claim 13 wherein the screed comprises two drive modules and two screed modules and further comprising a medial plate, the screed modules being coupled to the medial plate and the drive modules being coupled to the screed modules at distal ends thereof, and further comprising a power screw located between the screed modules proximate the medial plate for expanding the distance between tops of the screed modules so as to level the screed tubes relative to a ground surface.

17. The powered rotary screed of claim 13 wherein the screed comprises two drive modules having respective distal plate and intermediate plates, and two screed modules, and further comprising a medial plate, the screed modules being coupled to the medial plate and the intermediate plates, and each screed tube being rotatably coupled to the medial plate and a distal plate.

18. The powered rotary screed of claim 13 wherein the second drive tube is coupled to the plates at a location between the first drive tube and the screed tube.

19. The powered rotary screed of claim 13 wherein the second drive tube is coupled to the plates at a location between the first drive tube and the screed tube and the second drive tube is adjustable relative to the plates whereby the screed rests upon the first drive tube and the second drive tube when the screed is on a flat surface and adjustment of the second drive tube changes a distance between the screed tube and the surface upon which the screed rests.

* * * * *